United States Patent [19]

Zaghloul et al.

[11] Patent Number: 4,926,189

[45] Date of Patent: May 15, 1990

[54] HIGH-GAIN SINGLE- AND DUAL-POLARIZED ANTENNAS EMPLOYING GRIDDED PRINTED-CIRCUIT ELEMENTS

[75] Inventors: Amir I. Zaghloul, Bethesda; Robert M. Sorbello, Potomac, both of Md.

[73] Assignee: Communications Satellite Corporation, Washington, D.C.

[21] Appl. No.: 192,100

[22] Filed: May 10, 1988

[51] Int. Cl.[5] ..... H01Q 1/38

[52] U.S. Cl. ..... 343/700 MS; 343/756; 343/909; 343/849

[58] Field of Search ..... 343/700 MS, 746, 756, 343/767, 768, 769, 770, 778, 798, 909, 846, 847, 848, 849

[56] References Cited

U.S. PATENT DOCUMENTS 4,403,221 9/1983 Lamberg et al. ..... 343/700 MS
4,554,549 11/1985 Fassett et al. ..... 343/769
4,614,947 9/1986 Rammos ..... 343/786
4,623,894 11/1986 Lee et al. ..... 343/776

FOREIGN PATENT DOCUMENTS 0207029 11/1986 European Pat. Off. .

*Primary Examiner*—Rolf Hille
*Assistant Examiner*—Doris J. Johnson
*Attorney, Agent, or Firm*—Sughrue, Mion, Zinn, Macpeak & Seas

[57] ABSTRACT

A gridded radiating element for printed circuit antennas employing capacitive coupling of radiating elements to feedlines. The radiating element is formed of a grid wherein a metallization region is etched selectively to yield a plurality of metal strips disposed parallel to each other with a predetermined separation. This element, in contrast to known elements which employ solid metallization regions, finds particular application in dual polarization geometries, and enables improved performance over a wide bandwidth.

13 Claims, 6 Drawing Sheets

HIGH-GAIN SINGLE- AND DUAL-POLARIZED ANTENNAS EMPLOYING GRIDDED PRINTED-CIRCUIT ELEMENTS

BACKGROUND OF THE INVENTION

The present invention relates to a printed antenna whose elements are capacitively coupled to feedlines. More specifically, the invention relates to a high aperture efficiency, high polarization purity antenna element is transparent to orthogonally polarized radiation. The invention is applicable to printed circuit antennas employing single-polarization and dual-polarization geometries.

Printed circuit antennas employing capacitive coupling are known. A single-polarization version of such an antenna is disclosed in U.S. application Ser. No. 748,637, filed June 25, 1985, now U.S. Pat. No. 4,761,654. In that application, the disclosure of which is incorporated herein by reference, both linear and circular polarization are achieved in an antenna which employs capacitive coupling between the feedlines the feeding elements, and also between the feeding elements radiating elements.

Copending application Ser. No. 930,187, filed Nov. 13, 1986, discloses an improvement on the techniques disclosed in the first-mentioned application. The contents of that application also are incorporated herein by reference.

A dual-polarized printed circuit antenna is disclosed in copending application Ser. No. 165,332, filed Mar. 8, 1988, entitled "Dual-Polarized Printed-Circuit Antenna Employing Patches or Slots Capacitively Coupled to Feedlines", the named inventors being Robert M. Sorbello, John E. Effland, and Amir I. Zaghloul. In the last-mentioned application, a technique is provided wherein two senses of polarization, orthogonal to each other, may be achieved with appropriate isolation between the arrays of radiating elements. That application also is incorporated herein by reference.

An example of the dual polarization geometry is shown in FIG. 1, in which elements 1*a* and 1*b* are shown in element arrays 30, 50. These arrays are separated by an array of power dividers 40 which is associated with the element array 50, another power divider array 20 being associated with the element array 30. Details of implementation of this structure are provided in the last-mentioned copending application.

Previously-known configurations for radiating elements have employed either a patch or slot geometry, wherein circular or rectangular patches or slots, with or without perturbation segments provided thereon, may be provided. While the antennas as disclosed in the three above-mentioned applications have yielded good results over a relatively large bandwidth, the present inventors have discovered that it is possible to provide yet further improvement in performance.

SUMMARY OF THE INVENTION

In view of the foregoing, it is an object of the present invention to provide a radiating element for use in printed circuit antennas employing either single or dual polarization geometries, yielding improved performance over a wide bandwidth.

To this end, a radiating element of the present invention is formed based on a gridded structure which is transparent to one polarization while acting as a solid conducting plane to the other polarization. One form of this structure also makes the field distribution more uniform across the aperture. As a result, there is higher gain and a higher degree of isolation between the two orthogonal polarizations.

DETAILED DESCRIPTION OF THE PREFERRED EMBODIMENTS

As will be described in greater detail below, the arrays of gridded radiating elements of the present invention may be achieved by removing additional metal from the metallization layer from which the individual radiating slots are formed. Alternatively, some metal may be left in the slots selectively, so as to provide a gridded structure within the slots themselves.

Figure 3A:
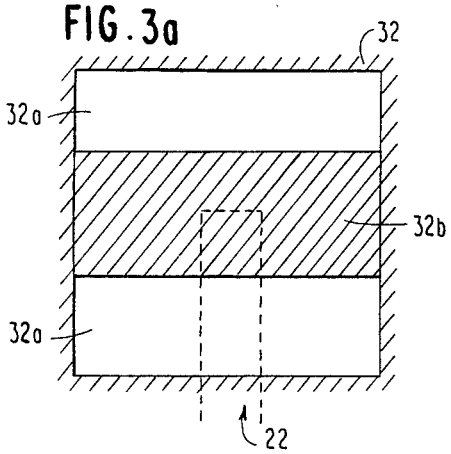
FIGS. 3*a* and 3*b* show examples of ungridded structures for array elements.

As shown in FIG. 3*a* an ungridded radiating element 32 comprises a pair of parallel slots 32*a* surrounding a single interior metallization region 32*b*. Such an element has a cosine distribution function for the aperture electric field, having a maximum at the slot center and tapering to zero at the edges.

Figure 1:
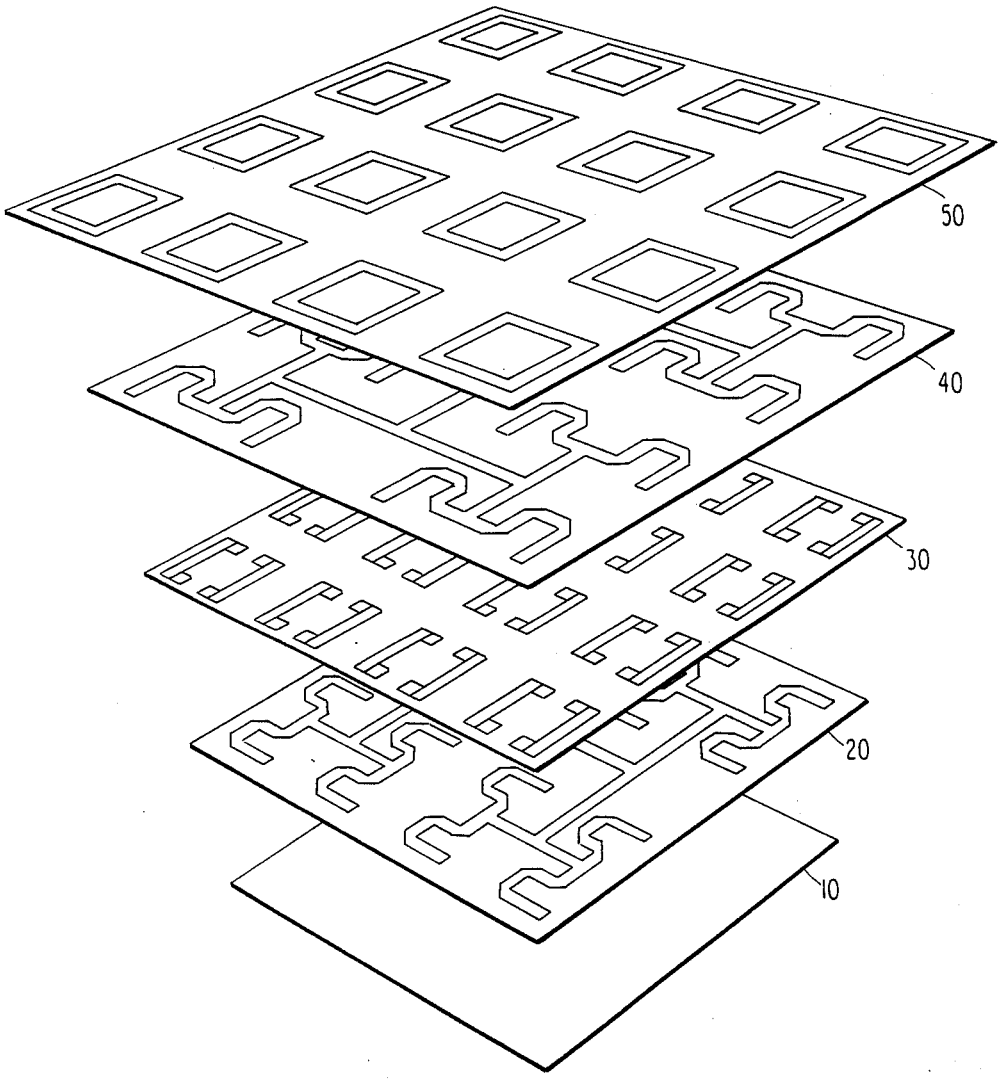
FIG. 1 of the application shows an example of dual polarization geometry with two arrays of radiating elements.
Figure 2A:
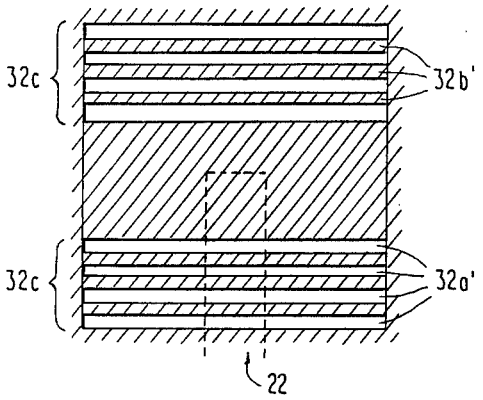
FIGS. 2*a* to 2*d* show examples of gridded structures in accordance with the present invention.

FIG. 2*a* differs from FIG. 3*a* in that two gridded regions 32*c* are provided. To form this structure, when the metallization is removed to form slots, the removal is more selective, so that thin metallization areas remain. By providing such structure, each wide slot 32*a* effectively is divided into an array of narrow slots 32*a* with thin metal regions 32*b*. The array of narrow slots has a more uniform distribution across the aperture, so as to increase the element gain.

Figure 4:
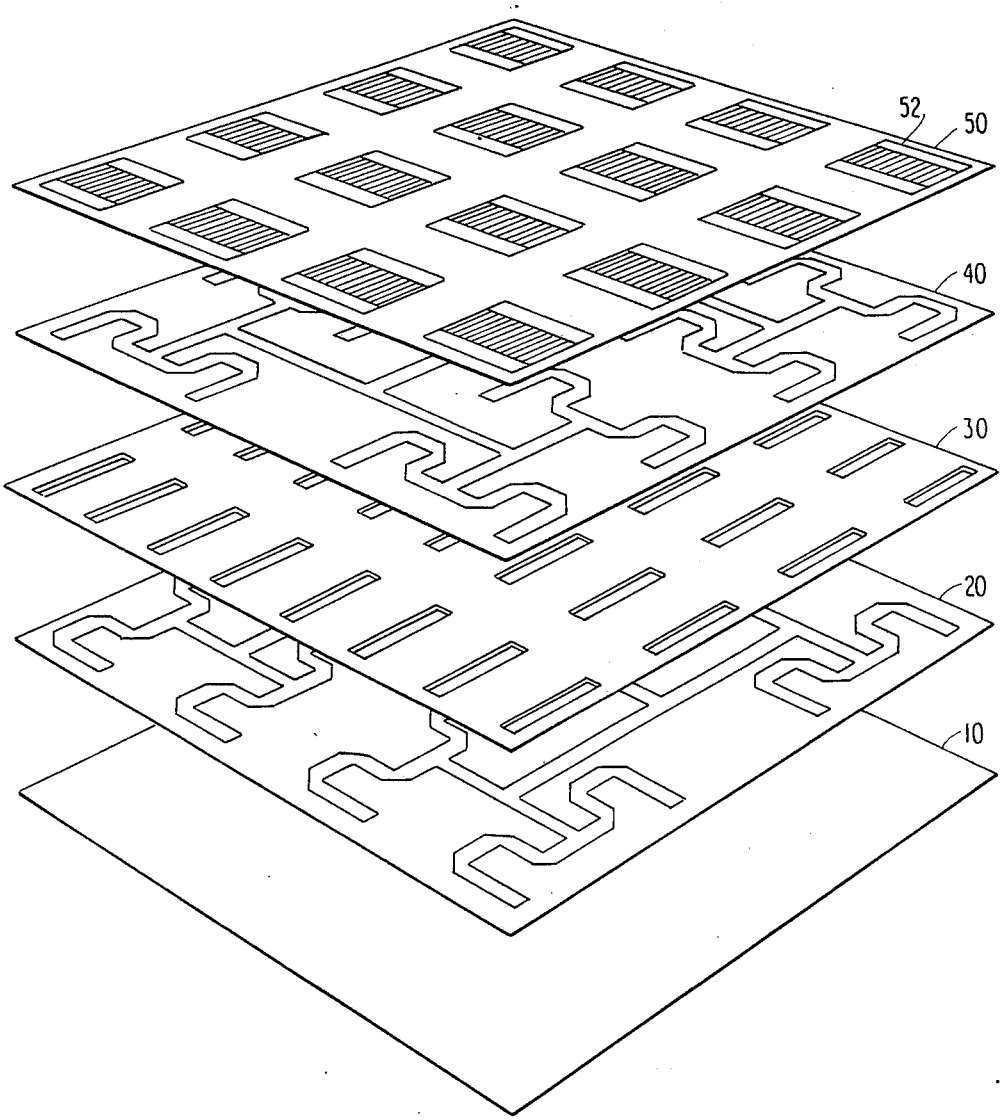
FIG. 4 shows a dual polarization geometry similar to FIG. 1, but with the elements of FIGS. 2*a* and 2*b.

The just-described structure may be implemented as shown in FIG. 4 in the lower element array 30. The gridding enables the element array 30 to appear more like a ground plane for the upper array, which operates in an orthogonal polarization, depending on the orientation of the feedline (e.g. 22, shown in outline) with respect to the grid structure of the radiating element (e.g. 32).

Figure 2B:
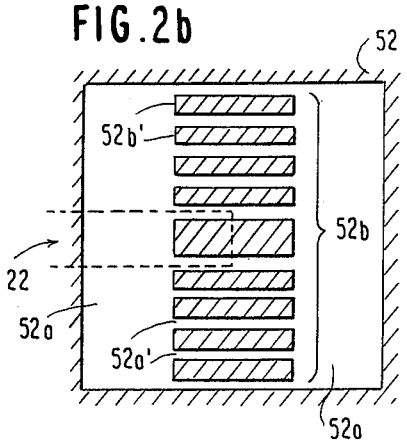

FIG. 2*b* shows an orthogonal feedline configuration which differs from FIG. 3*a* in that the radiating element 52 has an interior metal region 52*b* with additional metal removed, so that thin strips 52*b* are left. These strips are separated by spaces 52*a* where metallization has been removed. When used in a dual polarized array, the element in FIG. 2*b* is gridded in a direction orthogonal to the polarization of the second array and hence, is essentially transparent to this polarization. For example, FIG. 2*b* contains gridded elements that are orthogonal to the radiation associated with FIG. 3*a*.

Figure 2C:
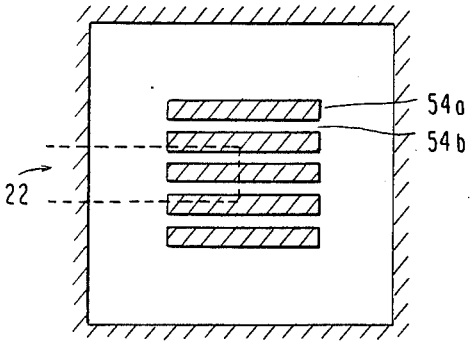
Figure 3B:
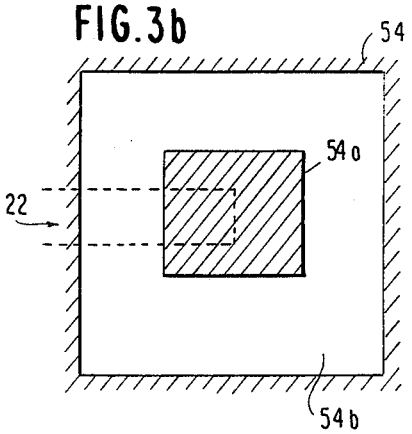

Similarly, FIG. 3*b* shows an ungridded element 54 with interior metallization region 54*a* and continuous surrounding slot 54*b*, and FIG. 2*c* shows a corresponding gridded element with remaining metal strips 54*a* and intervening spaces 54*b*, again with the feedline parallel to the grid as in FIG. 2*b*. If such an element is used in the top layer 50 of radiating elements shown in FIG. 4, the element will radiate at a polarization perpendicular to that of layer 30, with the orthogonally polarized radiation of layer 30 propagating through without being attenuated.

Figure 2D:
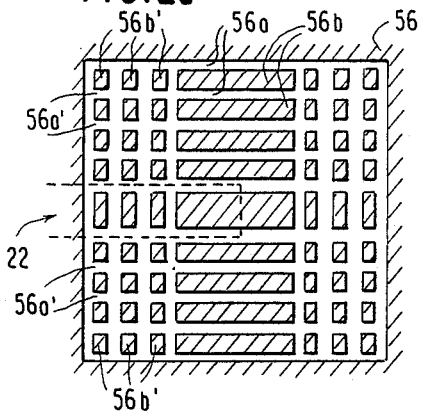

FIG. 2*d* shows another example of grid structure which is essentially a gridded version of FIG. 2*a*. Such structure yields an element 56 with central metallization portions 56*b* and outer metallization portions 56*b* within the slot regions. The gridded portions appear electrically continuous to a polarized signal parallel to the grids, and transparent to signals orthogonal to the grid.

In the foregoing embodiments, the strip width and spacing should be a small fraction of a wavelength of received radiation.

Figure 5:
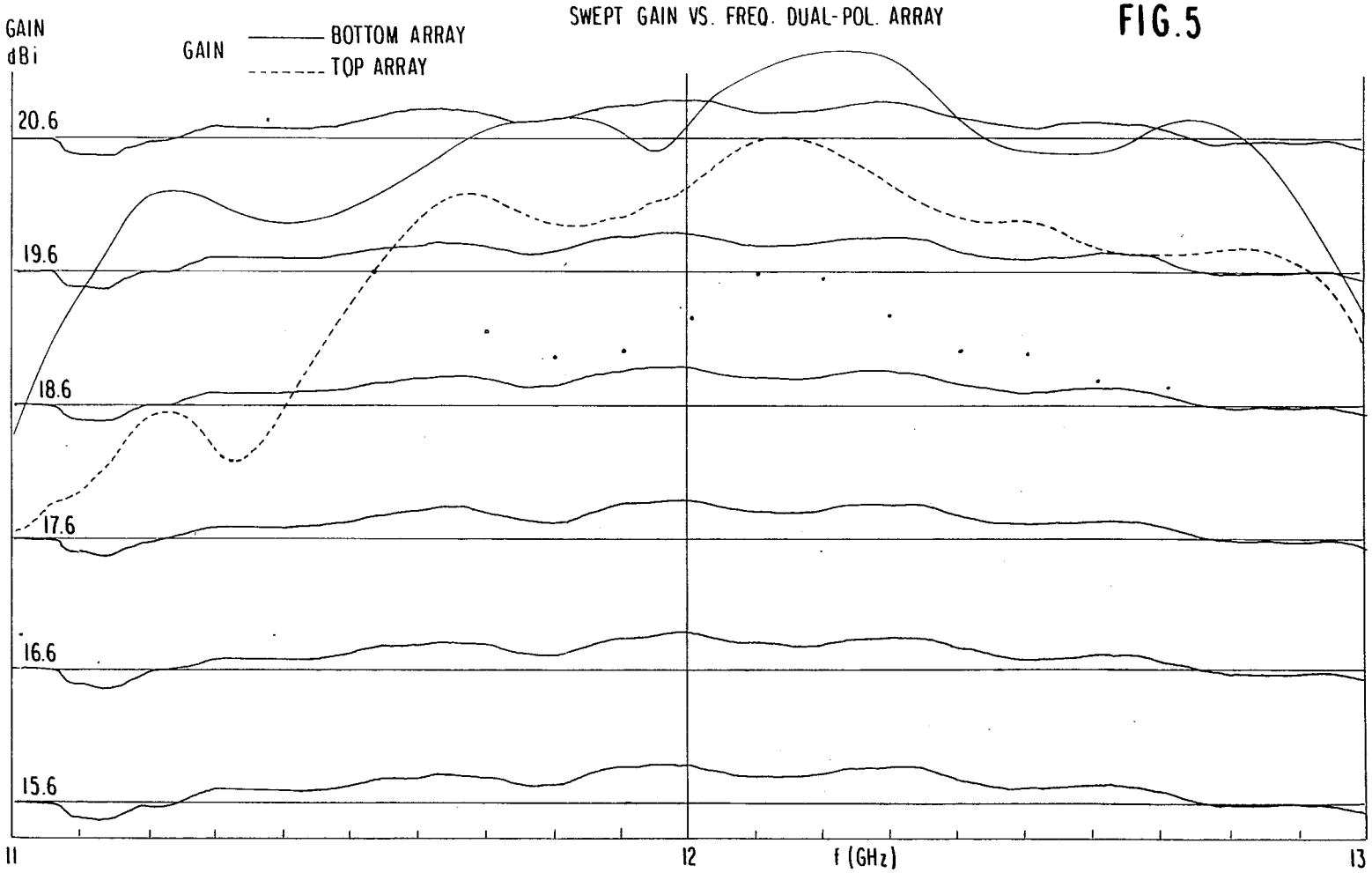
* and FIGS. 5 to 7 show the gain, polarization isolation, and port-to-port isolation of a 16-element array using the structure shown in FIG. 4.
Figure 6:
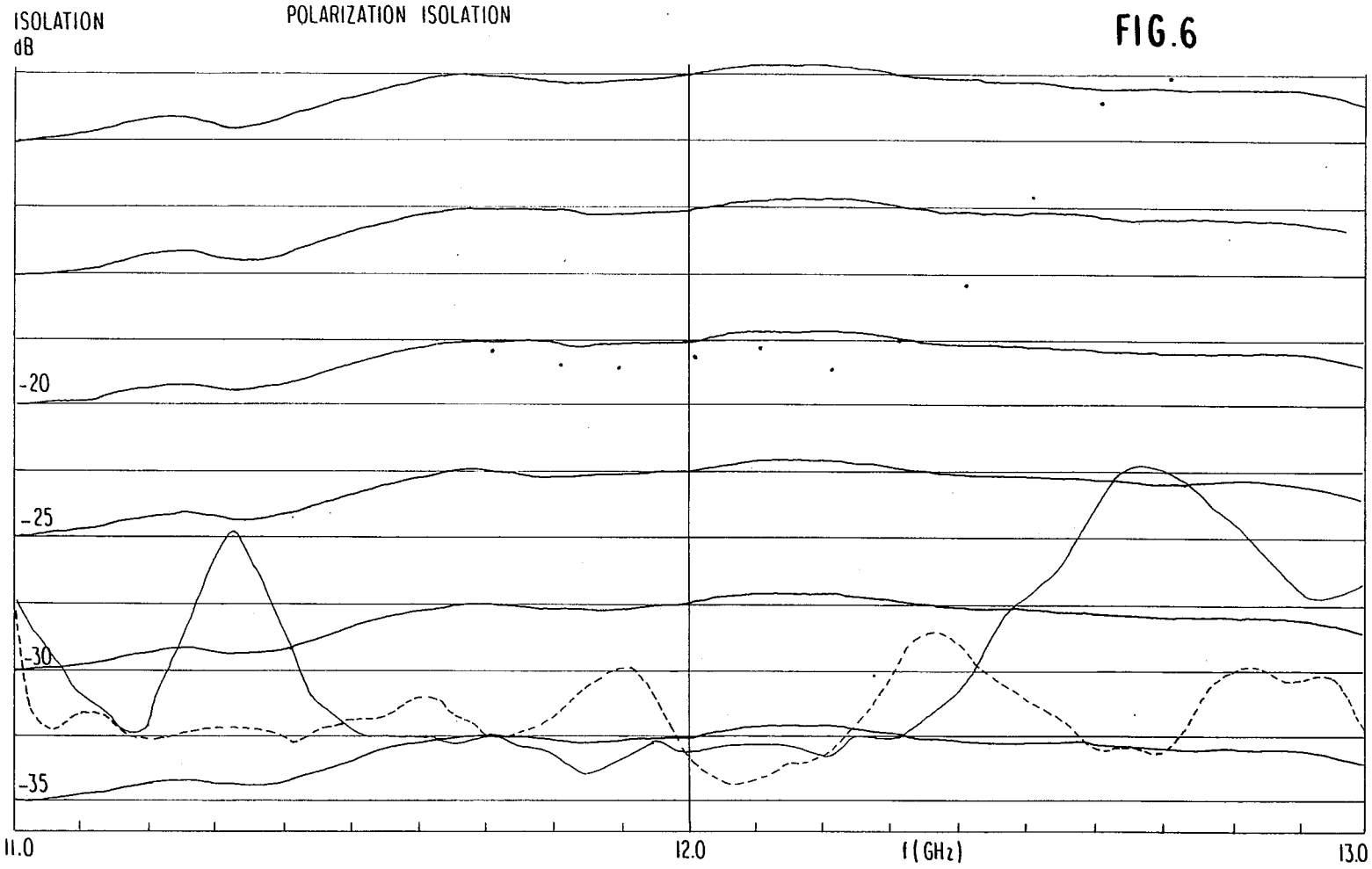
Figure 7:
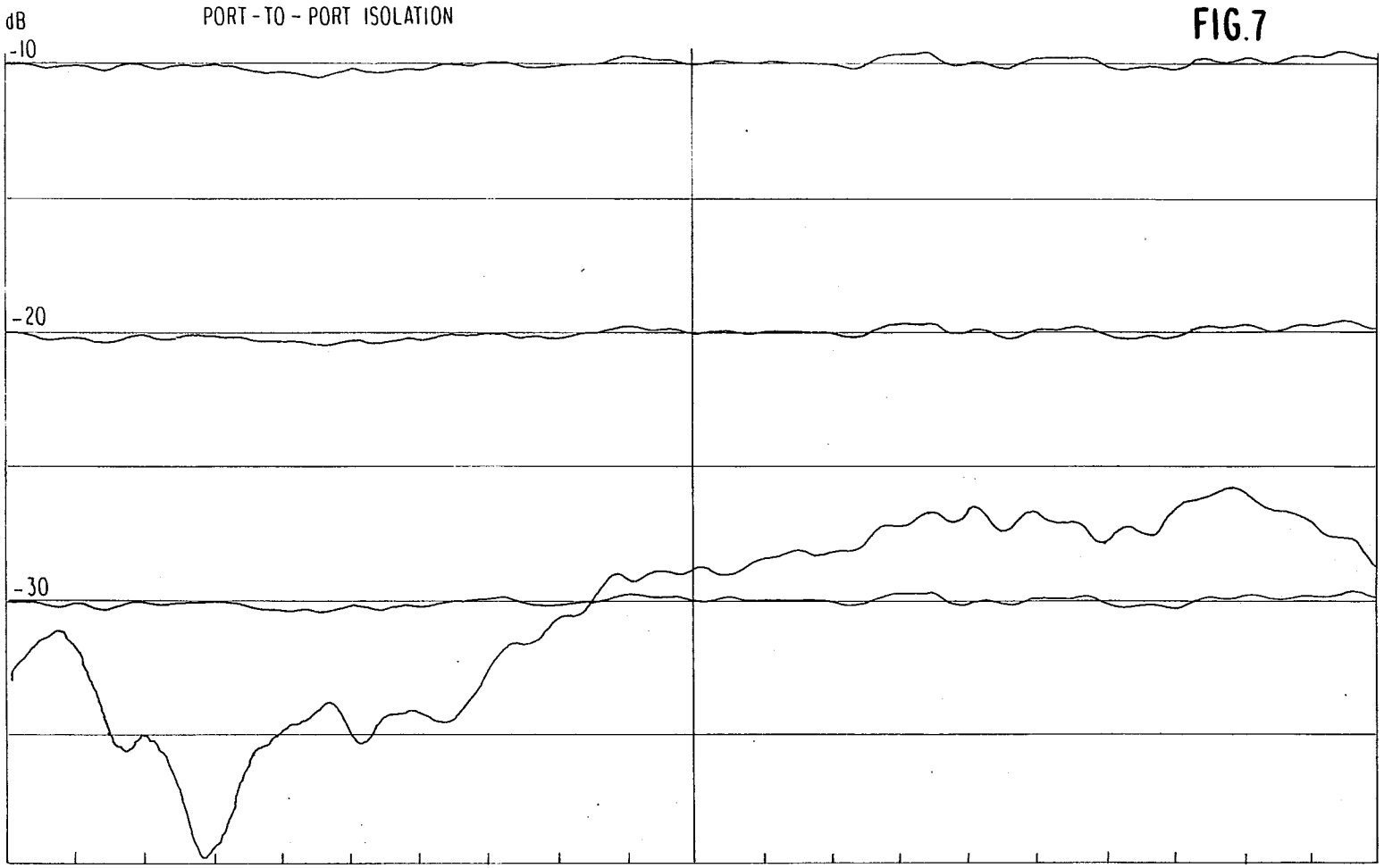

Pursuant to the foregoing description, the structure of the dual-polarized structure yields orthogonally polarized radiating element arrays 30, 50 which are completely isolated from each other, with each array performing in the same manner whether operated alone or in the dual-polarization environment. This is so despite the fact that the two arrays use the same overall projected aperture area. FIGS. 5 to 7 show the superior gain, polarization isolation, and port-to-port isolation achieved in a 16-element array using the FIG. 4 structure.

As described in the last-mentioned copending application, for a dual-polarization configuration, it is desirable to have the radiating elements of one array be of a slightly different shape from the other array, in order to provide superior isolation of the arrays. However, with the grids in the respective arrays being mutually orthogonal according to the present invention, the shapes may be similar, and either regular (as shown in FIG. 2*c*) or non-regular (as shown in FIGS. 2*a* and 2*b*), so that when placed perpendicular to each other, superior gain and isolation characteristics may be achieved.

The elements shown in FIGS. 2*a* to 2*d* may be connected to the power dividers at a single feedpoint, as described in Application Ser. No. 748,637, now U.S. Pat. No. 4,761,654, and Application Ser. No. 930,187, for a linearly polarized array. By connecting a quadrature hybrid at the input, the array may be operated so as to achieve dual circular polarization. An example of a quadrature hybrid is shown in FIG. 6 of the above-mentioned copending application Ser. No. 165 332, filed Mar. 8, 1988.

Also, while FIGS. 2*a* to 2*d* show generally rectangular- or square- shaped elements, it is considered to be within the scope of the invention that the techniques described may be applicable to elements of any arbitrary but predefined shape, such as a circular element or a rhomboid element. Thus, the invention is not to be considered as limited to the particular embodiments disclosed above, but rather is to be considered as limited only with respect to the scope of the appended claims which follow immediately.

What is claimed is:

1. A printed circuit antenna comprising a ground plane, a first power divider array disposed over and capacitively coupled to said ground plane, a first array of radiating elements disposed over and capacitively coupled to the first power divider array, a second power divider array disposed over and capacitively coupled to said first array of radiating elements, and a second array of radiating elements disposed over and capacitively coupled to said second power divider array, wherein said first array of radiating elements comprises:

a substrate; and a metallization layer formed over said substrate;

wherein each of said radiating elements in said first array of radiating elements comprises first, second, and third regions, at least one of said first through third regions comprising a gridded metallization region wherein metal is selectively removed and a plurality of parallel metal strips remain, said strips being separated at regular intervals by absences of said metal; and wherein said each of said radiation elements in said second array of radiating elements comprises fourth, fifth and sixth regions, at least one of said fourth through sixth regions comprising a gridded metallization region wherein metal is selectively removed and a plurality of parallel metal strips remain, said strips being separated at regular intervals by absences of said metal.

2. An antenna as claimed in claim 1, wherein said first and third regions have metallization completely removed therefrom to form slots, and said second region comprises said gridded metallization region.

3. An antenna as claimed in claim 1, wherein said first and third regions have metallization selectively removed therefrom to form additional gridded metallization regions.

4. An antenna as claimed in claim 3, wherein said second region has no metal removed therefrom.

5. An antenna as claimed in claim 1, wherein said fourth and sixth regions have metallization completely removed therefrom to form slots, and said fifth region comprises said gridded metallization region.

6. An anntenna as claimed in claim 1, wherein said fourth and sixth regions have metallization selectively removed threrfrom to form additional gridded metallization regions.

7. An antenna as claimed in claim 6, wherein said fifth region has no metal removed therefrom.

8. An antenna as claimed in claim 1, wherein said first power divider array feeds each of said radiating elements in said first array of radiating elements at a single feedpoint, and wherein said second power divider array feeds each of said radiating elements in said second array of radiating elements at a single feedpoint.

9. An antenna as claimed in claim 8, further comprising a quadrature hybrid connected to respective inputs of said antenna, so as to achieve two independent senses of circular polarization.

10. An antenna as claimed in claim 5, wherein said first and third regions have metallization completely removed therefrom to form slots, said second region comprising said gridded metallization region, and wherein said second array, of radiating elements is disposed with respect to said first array of radiating elements such that said first and second power divider arrays feed respective ones of said second and fifth regions in mutually orthogonal fashion.

11. A printed circuit antenna comprising:

a ground plane:

a first power divider array disposed over and capacitively coupled to said ground plane; and a first array of radiating elements disposed over and capacitively coupled to the first power divider array, wherein said first array of radiating elements comprises:

a substrate; and a metallization layer formed over said substrate;

wherein each of said radiating elements in said first array of radiating elements comprises a slot configuration in which a metal portion has slots on either side thereof, said slots being formed by removing portions of said metallization layer, such that one of said slots and said metal portion is formed as a gridded metallization region wherein metal is selectively removed and a plurality of parallel metal strips remain, said strips being separated at regular intervals by absences of said metal.

12. A printed circuit antenna as claimed in claim 11, wherein each of said radiating elements in said first array of radiating elements comprises first, second, and third regions, at least two of said first through third regions comprising said gridded metallization region.

13. A printed circuit antenna as claimed in claim 12, further comprising a second power divider array disposed over and capacitively coupled to said first array of radiating elements, and a second array of radiating elements disposed over and capacitively coupled to said second power divider array, wherein said each of said radiating elements in said second array of radiating elements comprises fourth, fifth, and sixth regions, at least two of said fourth through sixth regions comprising said gridded metallization region.

* * * * *

UNITED STATES PATENT AND TRADEMARK OFFICE

CERTIFICATE OF CORRECTION

PATENT NO. : 4,926,189

DATED : May 15, 1990

INVENTOR(S) : Amir I. Zaghloul et al.

It is certified that error appears in the above-identified patent and that said Letters Patent is hereby corrected as shown below:

Column 1, line 11, after "element" insert --which--.

Column 2, line 41, delete "32a" and insert --32a'--;

line 42, delete "32b" and insert --32b'--;

line 56, delete "52b" and insert --52b'--;

line 57, delete "52a" and insert --52a'--;

line 67, delete "54a" and insert --54a'--;

line 68, delete "54b" and insert --54b'--.

Column 3, line 10, delete "56b" and insert --56b'--.

Signed and Sealed this

Tenth Day of September, 1991

*Attest:*

*Attesting Officer*

HARRY F. MANBECK, JR.

*Commissioner of Patents and Trademarks*